US010273712B1

(12) United States Patent
Arnold, Jr.

(10) Patent No.: US 10,273,712 B1
(45) Date of Patent: Apr. 30, 2019

(54) WINDOW OPENING FOR A FENCE

(71) Applicant: James Douglas Arnold, Jr., Cantonment, FL (US)

(72) Inventor: James Douglas Arnold, Jr., Cantonment, FL (US)

( * ) Notice: Subject to any disclaimer, the term of this patent is extended or adjusted under 35 U.S.C. 154(b) by 0 days.

(21) Appl. No.: 15/920,443

(22) Filed: Mar. 13, 2018

(51) Int. Cl.
*E04H 17/14* (2006.01)
*E06B 1/36* (2006.01)

(52) U.S. Cl.
CPC ..... *E04H 17/1426* (2013.01); *E06B 1/36* (2013.01)

(58) Field of Classification Search
CPC ..... E04H 17/1426; E06B 5/00; E06B 9/01; E06B 9/52; E06B 1/36; A01K 1/035; A01K 3/00
See application file for complete search history.

(56) References Cited

U.S. PATENT DOCUMENTS

| | | | | |
|---|---|---|---|---|
| 4,856,575 | A * | 8/1989 | Wells | A01K 1/035 160/353 |
| 5,195,461 | A | 3/1993 | Brown | |
| 5,671,697 | A * | 9/1997 | Rutman | A01K 1/0245 119/472 |
| 6,581,668 | B1 * | 6/2003 | Oakley | A01K 3/00 160/180 |
| 9,072,275 | B2 | 7/2015 | Kleuskens | |
| 2007/0169426 | A1 * | 7/2007 | Allen | E06B 3/5892 52/204.59 |
| 2007/0227462 | A1 | 10/2007 | Huff | |
| 2015/0041743 | A1 * | 2/2015 | Richison | E04H 17/166 256/24 |

* cited by examiner

*Primary Examiner* — Andrew J Triggs
(74) *Attorney, Agent, or Firm* — Peter Loffler

(57) ABSTRACT

A window opening for a fence to allow dogs or other pets to see outside of a privacy fence uses a typical picket with an opening therein. An angle iron based frame has a base leg and a flange leg that approximates the size of the opening in the picket so that the flange of the frame is received within the opening of the picket. The frame is secured to the picket via an adhesive or via screws. A barrier may be located within the inner opening of the frame.

10 Claims, 6 Drawing Sheets

WINDOW OPENING FOR A FENCE

BACKGROUND OF THE INVENTION

1. Field of the Invention

The present invention relates to an opening in a typical privacy type fence to allow animals within a yard bounded by the fence to be able to easily see outside of the fence.

2. Background of the Prior Art

Many dog owners that live in a house have a privacy fence erected, typically about the perimeter of the backyard of the house, in order to allow the dog to be able to roam within the yard without the need for restrain or supervision. The fence keeps the dog from escaping where the dog can pose a risk to others as well as itself. Many dogs strive to see beyond the fence, especially when a person or other animal passes on the outside of the fence. While some fences have sufficient gaps between individual pickets to allow the dog to get a glimpse to the outside area of the fence, many fences are built sufficiently well so that such gaps are hard to come by. When the dog cannot see or can only see sporadically beyond the fence line, the dog often becomes anxious and may bark. Such barking can scare people on the other side of the fence and may annoy neighbors, especially if the barking is loud, prolonged, or occurs during sleeping hours.

In order to allow a dog to be able to see beyond the fence, fence windows have been proposed. These devices, which come in several architectures, install a window frame into an opening made into a section of the fence with the window filled with an appropriate barrier to prevent the dog from passing therethrough. Although these prior art devices allow a dog to have a good view beyond the fence line, the prior art device have certain shortcomings.

The prior art window fences require an opening be cut into several adjoining pickets of the fence, the size of the opening corresponding to the size of the window frame. While such a cut can be made on site after the fence is erected, making such a cut takes considerable skill which is outside the ability of the ordinary homeowner, even if the homeowner is somewhat skilled with saws and other cutting tools. Alternately, the opening is cut into the pickets either prior to installation onto the fence rails, or after removal therefrom for an existing fence. After the cuts are made, the fence pickets are installed onto the fence rails and then the window frame installed into the opening created within the multiple pickets. While this method of opening formation is easier relative to the in situ formation previously described, it still takes a certain skill set and ability to operate a saw in order to correctly make the cuts needed. Additionally, the individual cut pickets must be carefully aligned and installed onto their respective rails in order to have the opening correctly positioned as well as have the fence, especially the top of the fence, look attractive. Either described method of window installation into a fence is difficult, time consuming, and potentially costly if skilled tradesmen must be employed.

What is needed is a device that creates a visual opening in a fence without the need to perform complex cuts into multiple pickets of the fences so as to eliminate the need to hire skilled tradesman at substantial costs to the homeowner.

SUMMARY OF THE INVENTION

The window opening for a fence of the present invention addresses the aforementioned needs in the art by providing a device that forms a part of an overall privacy fence that allows a dog, or other animal or even a person, to be able to easily see through the fence to the other side of the fence. The window opening for a fence does not require a high degree of carpentry skill to install or maintain, the homeowner only needing to be able to use a hammer. The window opening for a fence is of relatively simple design and construction, being produced using standard manufacturing techniques, so as to make the device relatively inexpensive to produce so as to make the window opening for a fence economically attractive to potential consumers for this type of device.

The window opening for a fence of the present invention is comprised of a single fence picket that has a top and an opposing bottom joined by a first side and an opposing second side. A picket opening is located within the picket. The picket opening has a first outer periphery. A frame has a base leg with a front surface and a rear surface. The frame also has a flange extending outwardly from the rear surface of the base leg. The flange has a second outer periphery. The frame has a frame opening defined within an interior perimeter of the frame. The frame is attached to the picket such that the flange is disposed within the picket opening of the picket and such that the first outer periphery of the picket opening is shaped and dimensioned to approximately match the second outer periphery of the flange. The picket opening is disposed between the first side and the second side of the picket (not touching either of the two sides). The frame is secured to the picket either via an adhesive located on the rear surface of the base leg, the adhesive bonding with the picket proximate the picket opening or via a series of screws passing through the base leg and the picket proximate the picket opening. A barrier, of any appropriate design, is disposed within the frame opening, the barrier secured to the frame.

BRIEF DESCRIPTION OF THE DRAWINGS

Similar reference numerals refer to similar parts throughout the several views of the drawings.

DESCRIPTION OF THE PREFERRED EMBODIMENT

Figure 1:
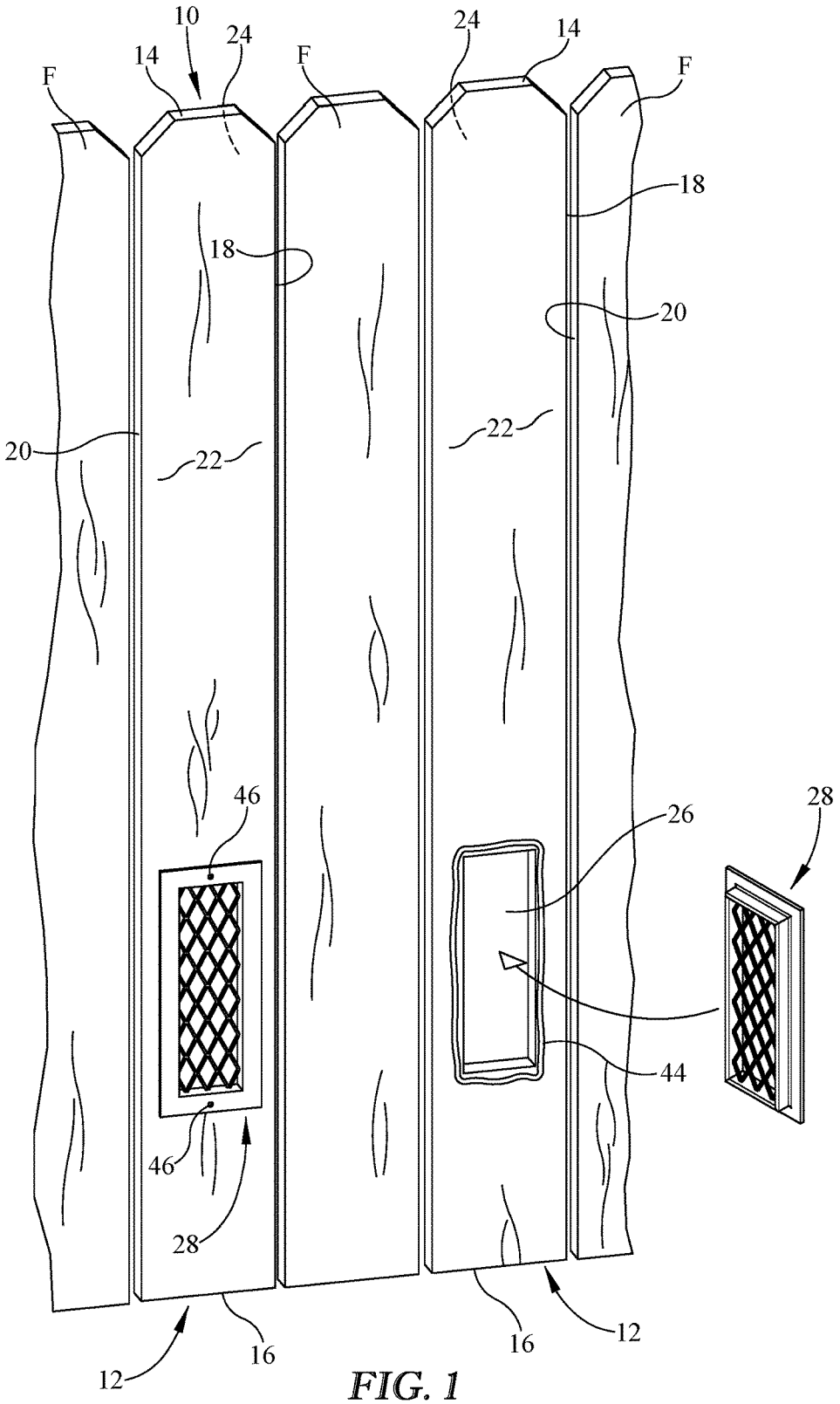
FIG. 1 is an environmental view of the window opening for a fence of the present invention.
Figure 2:
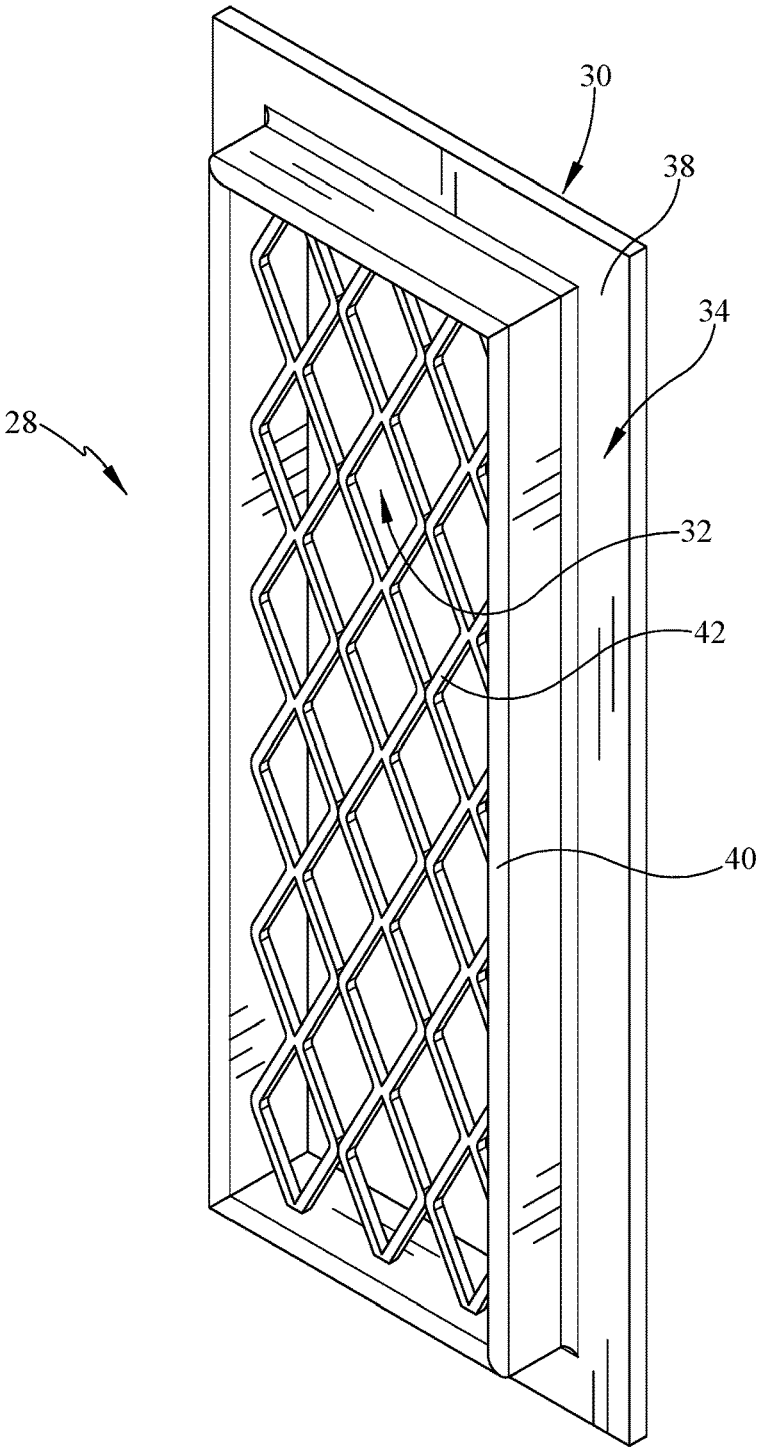
FIG. 2 is a perspective view of a typical window that is used within the window opening for a fence.
Figure 3:
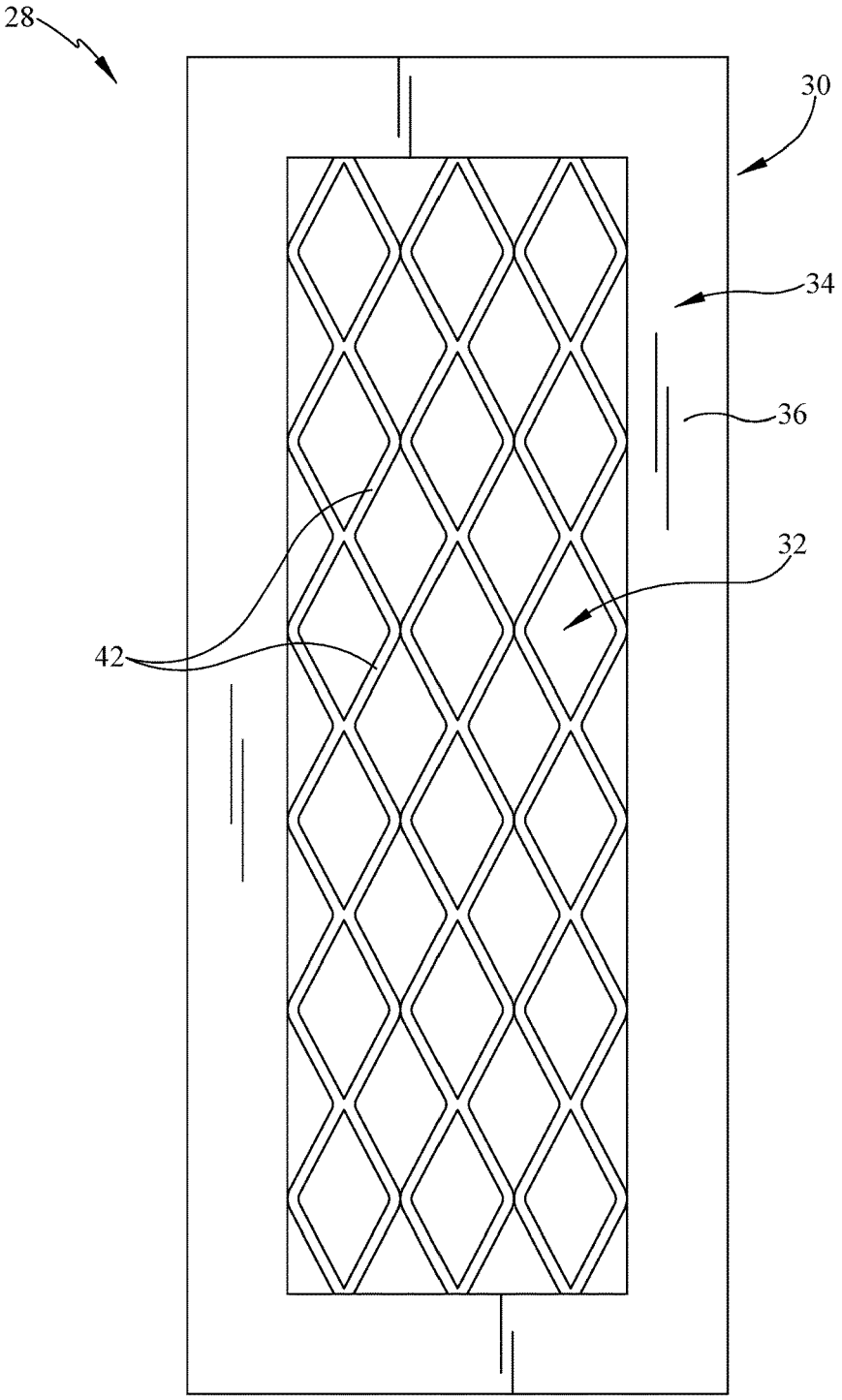
FIG. 3 is a front view of the typical window of FIG. 2.
Figure 4:
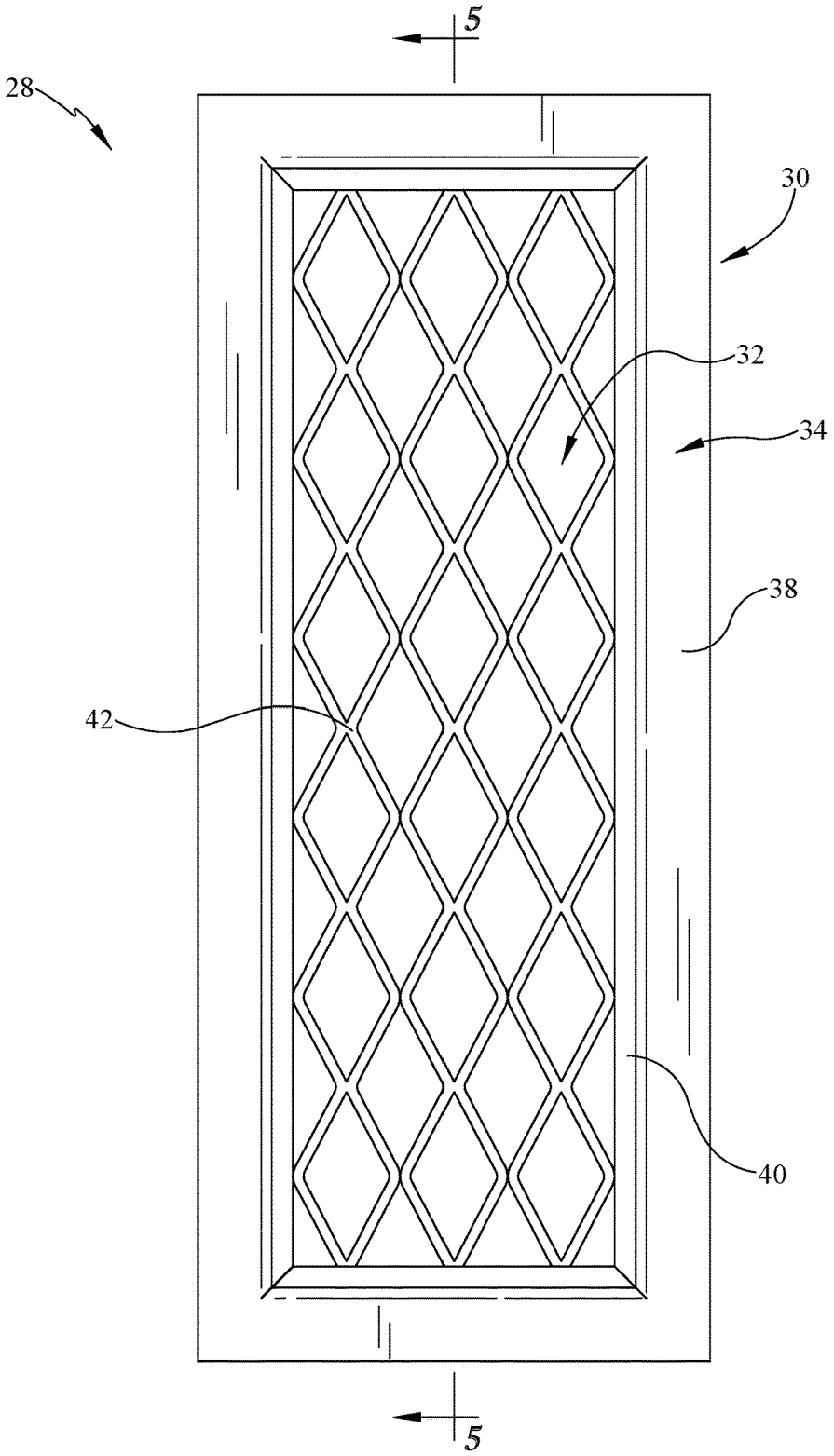
FIG. 4 is a rear view of the typical window of FIG. 2.
Figure 5:
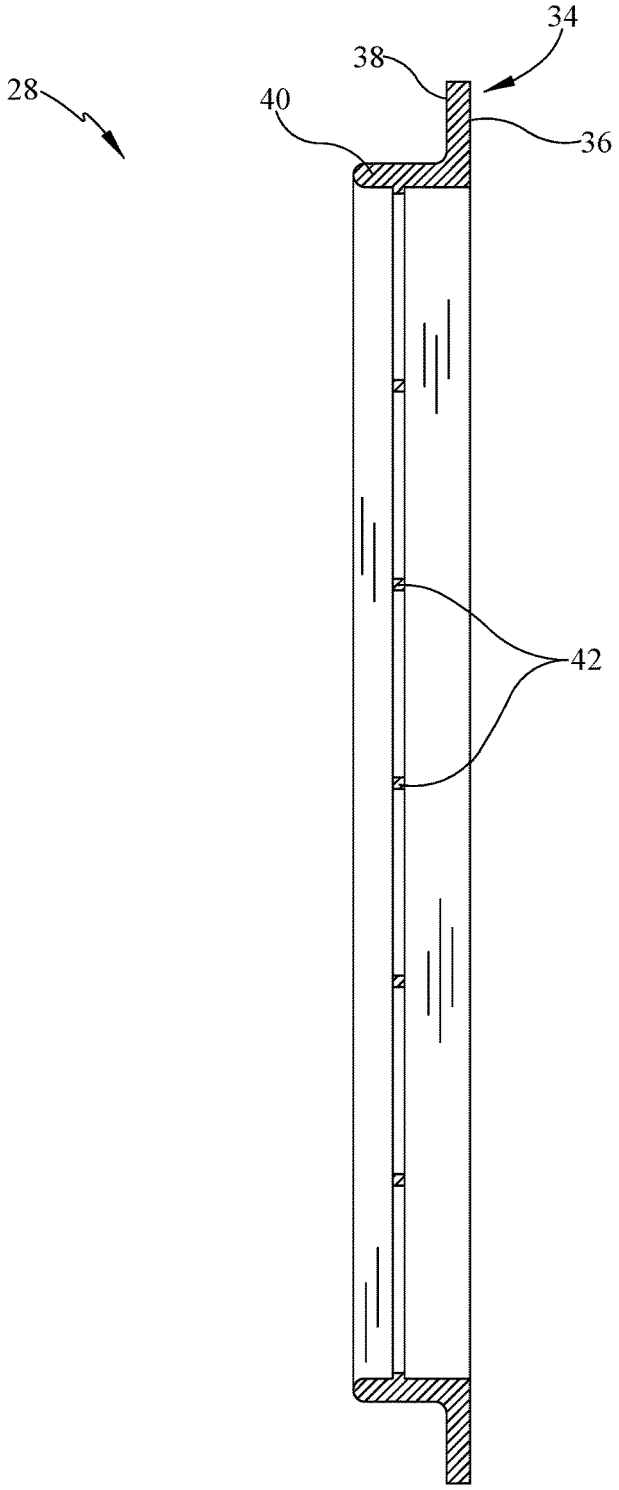
FIG. 5 is a sectioned view of the window of FIG. 2 taken along line 5-5 in FIG. 4.
Figure 6:
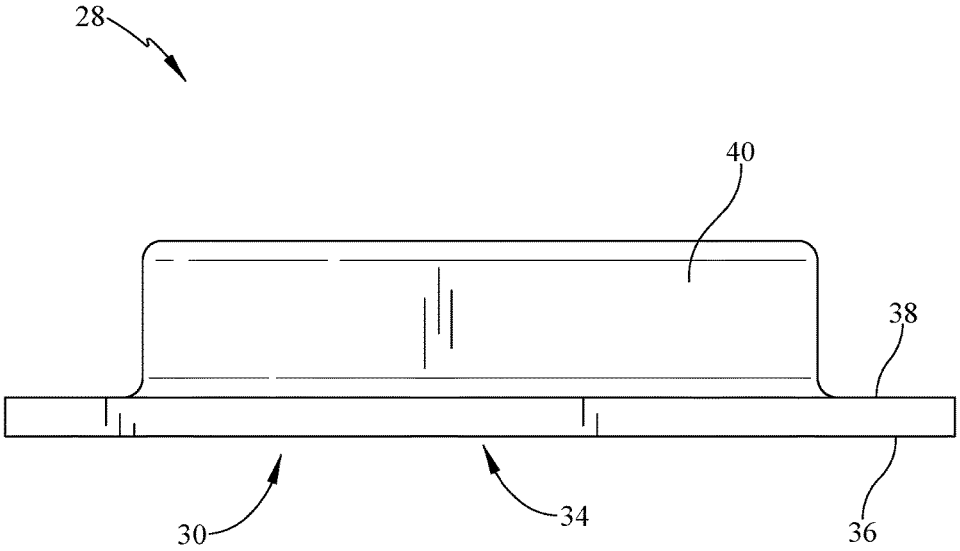
FIG. 6 is a top view of the typical window of FIG. 2.

Referring now to the drawings, it is seen that the window opening for a fence of the present invention, generally denoted by reference numeral 10, is comprised of fence picket 12 that has a top 14, an opposing bottom 16, a first side 18, and an opposing second side 20, a first surface 20, and an opposing second surface 24. The picket 12 is a typical picket, typically made from a fence picket appropriate material such as wood or wood-like material. A picket opening 26 is located within the picket 12, passing between the first surface 20 and the second surface 24 and located between the first side 18 and the second side 20, between being defined as the picket opening 26 not infringing on either the first side 18 or the second side 20.

A window 28 is provided and has a frame 30 and a fence opening 32 of any desired shape within the frame 30. The frame 30 is formed from angle iron so that the frame 30 has a base leg 34 with a front surface 36 and an opposing rear surface 38 and a flange 40 extending outwardly from the inner edge of the base leg 34, outwardly from the rear surface 38. The frame 30, which can be formed as a monolithic unit, is made from an appropriate material such as wood, metal, plastic, etc. An appropriate barrier 42 is located within the fence opening 32 of the frame 30 and held therein in appropriate fashion. The barrier 42 can be any appropriate barrier device such as the illustrated open mesh, a reasonably strong screen, Plexiglas, glass, etc., or the fence opening 32 can be left open if either the fence opening 32 is sufficiently small or the user has a relatively large dog that cannot pass through the fence opening 32.

The outer surface of the flange 40 is shaped and dimensioned to match the picket opening 26 so that the frame 30 is inserted, via the flange 40, into the picket opening 26 so that the frame 30 is held relatively snugly within the picket opening 26. The frame 30 is attached to the picket 12 in appropriate fashion such as by placing an appropriate adhesive 44 (the particular adhesive 44 being dependent on the material used to form the picket 12 and to form the frame 30), about the picket opening 26 so that once the frame 30 is inserted into the picket opening 26, the adhesive 44 adhesively engages the picket 12 as well as the frame 30, especially the rear surface 38 of the base leg 34 of the frame 30. Alternately, as also seen, appropriate screws 46 or bolts can be passed through the base leg 34 of the frame 30 and through the picket 12.

As the window frame 30 is disposed entirely within a single picket 12 there is no need to make complex cuts into multiple adjoining pickets so that the need for a high skill carpenter and/or the need to partially disassemble the fence is eliminated. The picket 12 and its attendant frame 30 can be produced at the factory so that the homeowner need only build the fence in the usual manner, placing the picket 12 with the frame 30 at one or more strategic locations along the fence line or allowing the homeowner to simply remove an existing picket P from the fence and replace it with the picket 12 and frame 30 combination. Alternately, the picket opening 26 can be formed by the homeowner.

The structure of the frame 30 gives the picket 12 the structural integrity lost due to the creation of the picket opening 26.

The window opening for a fence 10 has the additional advantage that it is relatively easy to replace one frame 30 with another frame 30, either to change the looks of the overall fence or to change the barrier 42, etc.

While the invention has been particularly shown and described with reference to an embodiment thereof, it will be appreciated by those skilled in the art that various changes in form and detail may be made without departing from the spirit and scope of the invention.

I claim:

1. A fence picket window comprising:

a fence picket having a top and an opposing bottom joined by a first side and an opposing second side, such that a picket opening is located within the fence picket such that the picket opening is fully bounded by and does not extend to the first side, the second side, the top and the bottom;

a frame having a base leg with a front surface and a rear surface, the frame also having a flange extending outwardly from the rear surface of the base leg, the frame also having a frame opening defined within an interior perimeter of the frame; and wherein the frame is attached to the fence picket such that the flange is disposed within the picket opening of the fence picket.

2. The fence picket window as in claim 1 wherein the frame is secured to the fence picket via an adhesive located on the rear surface of the base leg, the adhesive bonding with the fence picket proximate the picket opening.

3. The fence picket window as in claim 1 wherein the frame is secured to the fence picket via a series of screws passing through the base leg and the fence picket proximate the picket opening.

4. The fence picket window as in claim 1 wherein the frame is secured to the fence picket either via an adhesive located on the rear surface of the base leg, the adhesive bonding with the fence picket proximate the picket opening or via a series of screws passing through the base leg and the fence picket proximate the picket opening.

5. The window picket frame as in claim 1 further comprising a barrier disposed within the frame opening, the barrier secured to the frame.

6. A fence picket window comprising:

a fence picket having a top and an opposing bottom joined by a first side and an opposing second side, such that a picket opening is located within the fence picket, the picket opening having a first outer periphery, the first outer periphery forming a continuous closed loop so that the picket opening is fully bounded by and does not extend to the first side, the second side, the top and the bottom;

a frame having a base leg with a front surface and a rear surface, the frame also having a flange extending outwardly from the rear surface of the base leg, the flange having a second outer periphery, the frame also having a frame opening defined within an interior perimeter of the frame; and wherein the frame is attached to the fence picket such that the flange is disposed within the picket opening of the fence picket and such that the first outer periphery of the picket opening is dimensioned to match the second outer periphery of the flange.

7. The fence picket window as in claim 6 wherein the frame is secured to the fence picket via an adhesive located on the rear surface of the base leg, the adhesive bonding with the fence picket proximate the picket opening.

8. The fence picket window as in claim 6 wherein the frame is secured to the fence picket via a series of screws passing through the base leg and the fence picket proximate the picket opening.

9. The fence picket window as in claim 6 wherein the frame is secured to the fence picket either via an adhesive located on the rear surface of the base leg, the adhesive bonding with the fence picket proximate the picket opening or via a series of screws passing through the base leg and the fence picket proximate the picket opening.

10. The window picket frame as in claim 6 further comprising a barrier disposed within the frame opening, the barrier secured to the frame.

* * * * *